United States Patent [19]

Duckworth

[11] Patent Number: 5,050,132

[45] Date of Patent: Sep. 17, 1991

[54] ACOUSTIC DATA TRANSMISSION METHOD

[75] Inventor: Allen Duckworth, Middlefield, Conn.

[73] Assignee: Teleco Oilfield Services Inc., Meriden, Conn.

[21] Appl. No.: 610,433

[22] Filed: Nov. 7, 1990

[51] Int. Cl.[5] ..... G01V 1/40

[52] U.S. Cl. ..... 367/82

[58] Field of Search ..... 367/82; 340/857, 858

[56] References Cited

U.S. PATENT DOCUMENTS

| | | | |
|---|---|---|---|
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,314,365 | 2/1982 | Petersen et al. | 367/82 |
| 4,390,975 | 6/1983 | Shawhan | 367/82 |
| 4,562,559 | 12/1985 | Sharp et al. | 367/82 |

OTHER PUBLICATIONS

Drumheller, D. S., "Acoustical Properties of Drill Strings," J. Acoust. Soc. Amer., vol. 85, #3, Mar. 1985.

*Primary Examiner*—Ian J. Lobo

*Attorney, Agent, or Firm*—Fishman, Dionne & Cantor

[57] ABSTRACT

A method of acoustically trasmitting data signals over a drillstring is presented. In accordance with the present invention, acoustic data is transmitted only during preselected short time intervals thereby avoiding destructive interference caused by the signal being reflected back and forth from the ends of the drillstring. The present invention makes use of the fact that the first reflective wave has to travel three times the length of the drillstring before it can interfere with the original data signal. For example, the time for the first wave to travel three times the length of the drillstring can be in the order of one second. Therefore, if the data content of the transmission signal is confined to the first one second or so of transmission, then a transmission channel relatively free of interference is available for data transfer.

5 Claims, 3 Drawing Sheets

ACOUSTIC DATA TRANSMISSION METHOD

BACKGROUND OF THE INVENTION

This invention relates generally to a method for acoustically transmitting data along a drillstring, and more transmissions by transmitting the data during preselected short time intervals thereby avoiding destructive interference caused by reflected acoustic waves.

Deep wells of the type commonly used for petroleum or geothermal exploration are typically less than 30 cm (12 inches) in diameter and on the order of 2 km (1.5 miles) long. These wells are drilled using drillstrings assembled from relatively light sections (either 30 or 45 feet long) of steel drillpipe that are connected end-to-end by tool joints, additional sections being added to the uphole end as the hole deepens. The downhole end of the drillstring typically includes a dead weight section assembled from relatively heavy lengths of uniform diameter steel tubes ("drill collars") having an overall length on the order of 300 meter (1000 feet). A drill bit is attached to the downhole end of the lowermost drill collar, the weight of the collars causing the bit to bite into the earth as the drillstring is rotated from the surface. Sometimes, downhole mud motors or turbines are used to turn the bit. Drilling mud or air is pumped from the surface to the drill bit through an axial hole in the drillstring. This fluid removes the cuttings from the hole, can provide a hydrostatic head which controls the formation fluids, and provides cooling for the bit.

Communication between downhole sensors of parameters such as pressure or temperature and the surface has long been desirable. Various methods that have been used or attempted for this communication include electromagnetic radiation through he ground formation, electrical transmission through an insulated conductor, pressure pulse propagation through the drilling mud, and acoustic wave propagation through the metal drillstring. Each of these methods has disadvantages associated with signal attenuation, ambient noise, high temperatures, and compatibility with standard drilling procedures. The most commercially successful of these methods has been the transmission of information by pressure pulses in the drilling mud (known as mud pulse telemetry). However, such systems are generally limited to a transmission rate of about one (1) data bit per second.

Faster data transmission may be obtained by the use of acoustic wave propagation through the drillstring, because much higher frequencies can be transmitted. While this method of data transmission has heretofore been regarded as impractical, a significantly improved method and apparatus for the acoustic transmission of data through a drillstring is disclosed in U.S. patent application Ser. No. 605,255 filed Oct. 29, 1990, entitled "ACOUSTIC DATA TRANSMISSION THROUGH A DRILL STRING" which is a continuation-in-part of now abandoned U.S. application Ser. No. 453,371 filed Dec. 22, 1989 (all of the contents of the CIP application being fully incorporated herein by reference), which will permit large scale commercial use of acoustic telemetry in the drilling of deep wells for petroleum and geothermal exploration.

U.S. Ser. No. 605,255 describes an acoustic transmission system which employs a downhole transmitter for converting an electrical input signal into acoustic energy within the drill collar. The transmitter includes a pair of spaced transducers which are electronically controlled. The electronics control phasing of electrical signals to and from the transducers so as to produce an acoustical signal which travels in only one direction, and so directs the transmission only towards the receiver.

In acoustic data transmissions along a segmented tubular structure such as drill pipe used for drilling a well as described above, there exist both passband and stop-band frequency domains. The frequencies of these bands are determined by the material properties of the tubular structure as well as the geometry of the segments. Data can be transmitted readily at the passband frequencies, but signals at the stop-band frequencies are rapidly attenuated by local internal reflections and thus lost. Also, within the passbands there is a fine structure of low loss frequency regions interspersed with other regions where very high attenuation occurs. This fine structure is described in some detail in an article entitled "Acoustic Properties of Drillstrings" by Douglas S. Drumheller, J. Acoust. Soc. Am 85 (3), pp. 1048–1064, March 1989. As described in the Drumheller paper, the fine structure bands are caused by the destructive interference of acoustic waves reflected from the ends of the tube with the original signal wave, when the two waves arrive at the receiver substantially out of phase. As a result of this fine structure phenomenon, the low attenuation regions depend upon the overall length of the tube. This makes for difficulties in transmitting data when the overall length of the tube is changing, as in drilling operations where the depth of the well, and hence the length of the tube (drill pipe) is constantly increasing thereby changing the fine structure. Because of the presence of this fine structure and the constantly changing nature of the fine structure, it is very difficult to identify and utilize the optimal transmission frequency for accurately transmitting acoustic data signals.

SUMMARY OF THE INVENTION

The above-discussed and other problems and deficiencies of the prior art are overcome or alleviated by the method of acoustically transmitting data signals of the present invention. In accordance with the present invention, acoustic data is transmitted only during preselected short time intervals thereby avoiding destructive interference caused by the reflective acoustic waves (fine structure bands). The present invention makes use of the fact that the first reflective wave has to travel three times the length of the drillstring before it can interfere with the original acoustic signal. If the data content of the transmission signal is confined to the time for the first wave to travel three times the length of the drillstring then the full passband (free of any interfering fine structure) is available for data transfer. Under typical drilling conditions, the method of the present intention will permit an effective acoustic transmission of data signals of at least six (6) bits per second as an effective data rate. This data rate is about six times faster than data rates achievable using mud pulse telemetry. Thus, the present invention will increase data transfer under measurement-while-drilling conditions by at least six times over conventional techniques.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
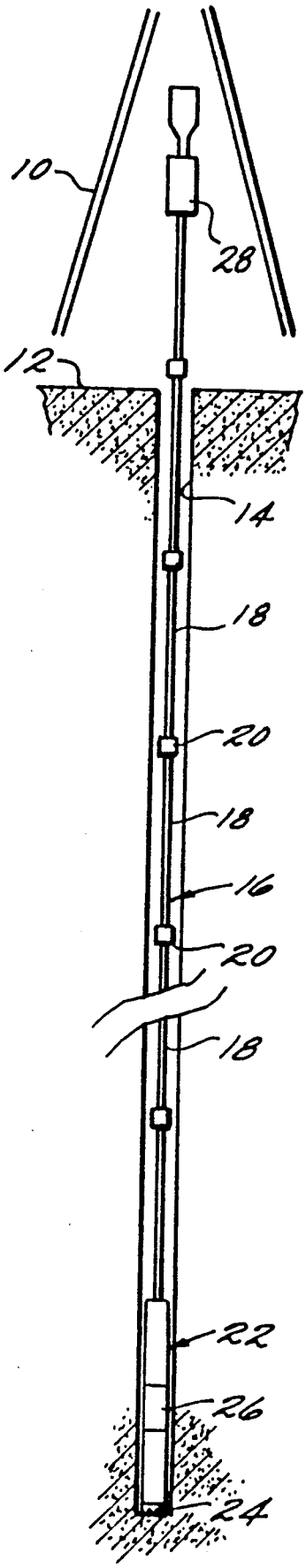
FIG. 1 is a cross-sectional elevation view depicting a downhole drilling apparatus and drillstring employing an acoustic signal transmission means in accordance with the present invention.

Referring first to FIG. 1, a schematic of a drillstring utilizing an acoustic telemetry system such as the type described in U.S. Ser. No. 605,255 is shown. In FIG. 1, a drilling rig 10 is positioned on the surface 12 above a borehole 14 which is traversed by a drillstring 16. Drillstring 16 is assembled from sections of drill pipe 18 that are connected end-to-end by tool joints 20. It will be appreciated that additional sections of drill pipe 18 are added to the uphole end of drillstring 16 as the hole deepens. The downhole end of the drillstring includes a drill collar 22 composed of drill collar pipe having a diameter which is relatively larger than the diameter of the drill pipe sections 18. Drill collar section 22 includes a bottom hole assembly which terminates at drill bit 24 and which may include several drill collar sections housing downhole sensors for sensing parameters such as pressure, position or temperature. In accordance with the present invention, one of the drill collar sections includes an acoustic transmitter 26 which communicates with an acoustic receiver 28 uphole of drillstring 16 by the transmission of acoustic signals through the drillstring. One embodiment of the acoustic transmitter 26 and receiver 29 is described in detail in U.S. Ser. No. 605,255, which has been fully incorporated herein by reference.

Figure 2:
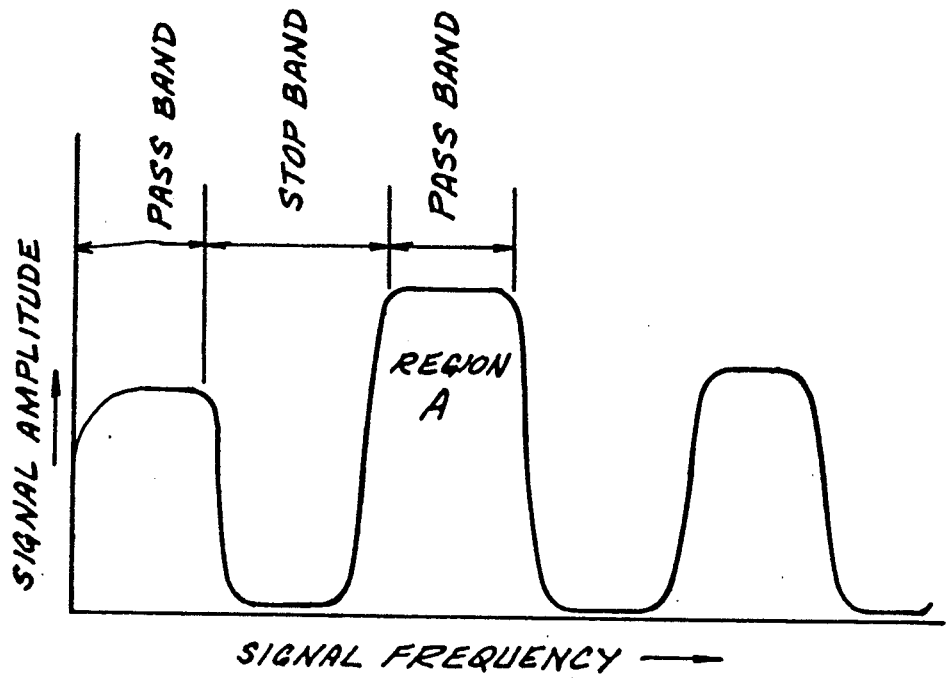
FIG. 2 is a graph of signal amplitude versus signal frequency in an acoustic transmission system depicting the several passbands and stop-bands for an initial characteristic of a received signal.

Acoustic transmitter 26 transmits acoustic signals which travel along drillstring 16 at the local velocity of sound, that is, about 16,000 feet per second if the waves are longitudinal and 10,000 feet per second if they are torsional. As shown in FIG. 2, the initial characteristic of a signal received by receiver 28 which has been transmitted by acoustic transmitter 26 has a plurality of alternating passbands and stop-bands with respect to signal frequency. It will be appreciated that the frequency chosen by acoustic transmitter 26 should be one which is in the high amplitude reception section of a passband (for instance "Region A").

Figure 3:
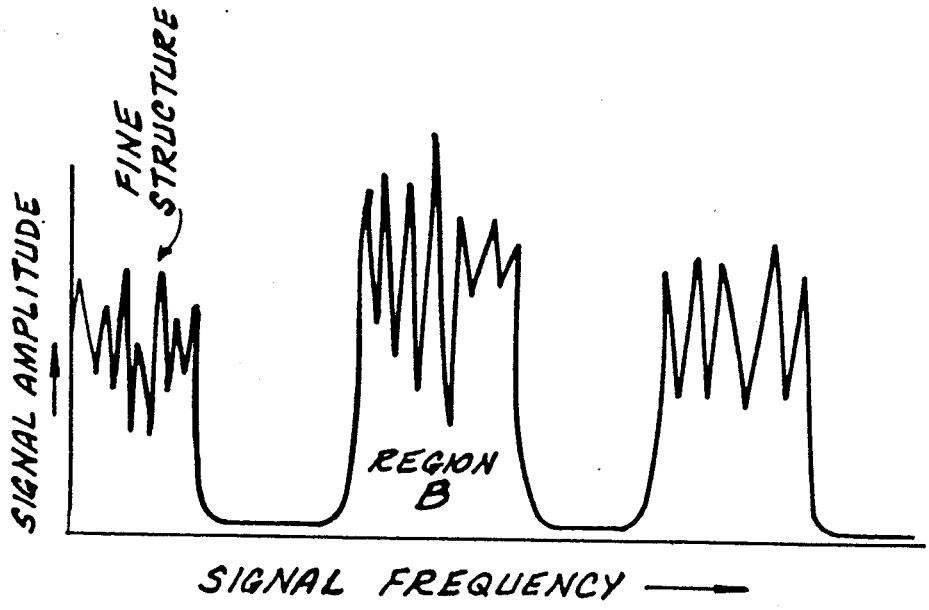
FIG. 3 is a graph similar to FIG. 2 depicting the stop-bands and pass bands of later characteristics of the received signals wherein the "fine structure" appears.

Unfortunately, the broad passbands of FIG. 2 do not remain unchanged with time. Instead, interfering signals resulting from the reflection of the original transmitted signal break up the broad passbands into what is termed "fine structure" shown in FIG. 3. FIG. 3 depicts the characteristics of the received signal subsequent to interference by reflected signals and therefore exhibiting the "fine structure". The existence of this fine structure can significantly degrade the data channel (compare for example, Region B in FIG. 3 to Region A in FIG. 2).

In accordance with the present invention, the data content of the transmitted signal is confined to a preselected time period prior to the appearance of the fine structure (FIG. 3) so that a wide passband is available for transmission as in FIG. 2. After that time period, reflective data signals will cause disruptive interference and the "fine" structure of FIG. 3.

The time window available for clear transmission (i.e., the broad pass bands of FIG. 2 as opposed to narrow fine structure of FIG. 3) will be dependent upon the depth of the transmission. For example, at a depth of 1,000 feet, the time window is at least 0.125 seconds (i.e., it will take 0.125 seconds for a data signal to travel three (3) lengths of the drill pipe or 3,000 feet). If we allow about 1-5 seconds for echoing signals to fade (e.g., ring-down time), then the data signals may be repeated approximately every two seconds (30 repetitions per minute). Therefore, data can be transmitted for $30 \times 0.125$ seconds $= 3.75$ seconds each minute.

The maximum data rate will depend on the bandwidth of the data channel, the coding scheme used, the signal-to-noise ratio, etc. If, for example, a data rate of 100 bits/second can be achieved during the transmission periods, then the average data rate will be about 6 bits/-second at 1000 feet depth. This effective data rate will increase with depth because the time window becomes longer, while the ring-down time is constant.

In still another feature of the present invention, data transmission may be carried out using two or more passbands simultaneously.

Figure 4:
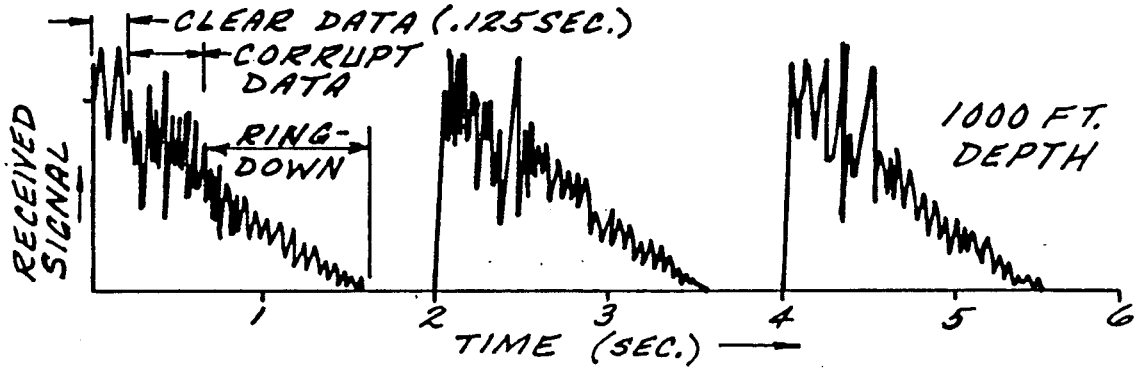
FIGS. 4 and 5 are respective graphs of signal versus time depicting several examples of the method of the present inventions.
Figure 5:
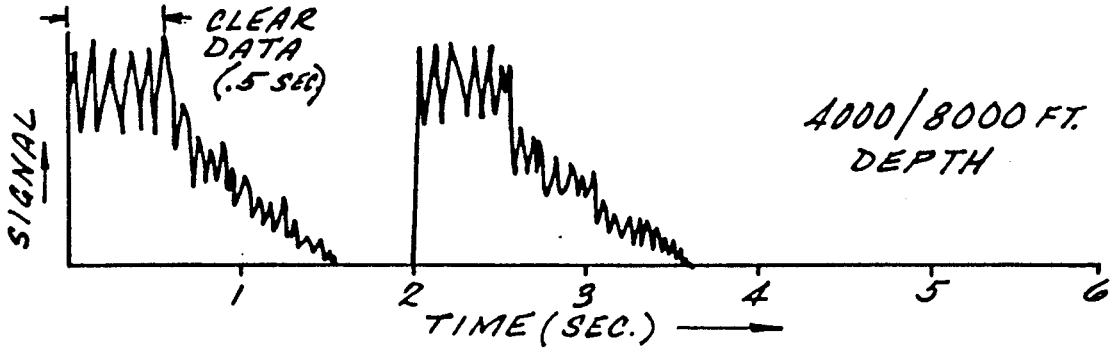

If a fixed time schedule is utilized, for example, 0.5 seconds of data in a 2.0 second pause, the graph of FIG. 5 shows the effective data quality versus time. At shallow depth (FIG. 4), a fraction of the 0.5 second data burst will be corrupted.

Preferably, the transmitter and receiver should be synchronized since the first part of the signal cannot be wasted in tuning the receiver to its frequency. This can be accomplished by transmitting a second signal in another passband, this signal being modulated only with a continuous wave for timing purposes. In this way, the receiver could be prepared to accept a data burst at the precise time it is sent. As an alternative, the incoming signal may be recorded continuously and the data burst decoded in an off-line mode without real time constraints.

This method may also be used in an exactly similar manner to transmit data or instructions from the surface to an instrument or device located at the bottom of the drillstring.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for transmitting data through a drillstring having a plurality of drill pipe sections connected end-to-end by joints from a first location below the surface of the earth to a second location at or near the surface of the earth, the length and cross-sectional area of the drill pipe sections being different from the length and cross-sectional area of the joints, the method comprising the steps of:

(1) generating acoustic data signals having a single frequency content in at least one passband of the drillstring;

(2) transmitting said data signals through the drillstring from either said first location to said second location or from said second location to said first location during a time period prior to the onset of reflective interference caused by said data signals reflecting from along the length of the drillstring, said time period being equal to or less than the time for said data signals to travel three lengths of the drillstring;

(3) stopping the transmission of data signals at the onset of said reflective interference and allowing the acoustic signals to substantially attenuate; and (4) detecting the data signals at said respective first or second location.

2. The method of claim 1 including the step of:

repeating steps (1)-(4) continuously over a preselected time period using the acoustic signals for the transmission of data acquired by sensor means located in the drillstring.

3. The method of claim 1 including the step of:

repeating steps (1)-(4) simultaneously over a preselected time period using data signals having different frequencies, said different frequencies being located in the same or different passbands.

4. The method of claim 1 wherein an acoustic transmitter is located at said first location and an acoustic receiver is located at said second location and including the step of:

synchronizing the frequency of the transmitter to the frequency of the receiver.

5. An apparatus for transmitting data through a drillstring having a plurality of drill pipe sections connected end-to-end by joints from a first location below the surface of the earth to a second location at or near the surface of the earth, the length ad cross-sectional area of the drill pipe sections being different from the length and cross-sectional area of the joints, comprising:

means for generating acoustic data signals having a single frequency content in at least one passband of the drillstring;

means for transmitting said data signals through the drillstring from either said first location to said second location or from said second location to said first location during a time period prior to the onset of reflective interference caused by said data signals reflecting from along the length of the drillstring, said time period being equal to or less than the time for said data signals to travel three lengths of the drillstring;

means for stopping the transmission of data signals at the onset of said reflective interference and allowing the acoustic signals to substantially attenuate; and means for detecting the data signals at said respective first or second location.

* * * * *

UNITED STATES PATENT AND TRADEMARK OFFICE

CERTIFICATE OF CORRECTION

PATENT NO. : 5,050,132

DATED : 9/17/91

INVENTOR(S) : Allen Duckworth

It is certified that error appears in the above-identified patent and that said Letters Patent is hereby corrected as shown below:

Column 1, line 7, Between "and more" and "transmissions" insert --particularly to a method of enhancing acoustic data--

Column 1, line 21, Change "meter" to "meters"

Column 1, line 35, Delete "he" and insert therefore --the--

Column 2, line 58, Delete "intention" and insert therefore --invention--

Signed and Sealed this

Twenty-second Day of February, 1994

*Attest:*

Bruce Lehman

BRUCE LEHMAN

*Attesting Officer*

*Commissioner of Patents and Trademarks*